US010458649B2

(12) United States Patent
Karkow et al.

(10) Patent No.: US 10,458,649 B2
(45) Date of Patent: Oct. 29, 2019

(54) HORIZONTALLY FIRED BURNER WITH A PERFORATED FLAME HOLDER

(71) Applicant: ClearSign Combustion Corporation, Seattle, WA (US)

(72) Inventors: Douglas W. Karkow, Des Moines, WA (US); Joseph Colannino, Bellevue, WA (US); Igor A. Krichtafovitch, Kirkland, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 305 days.

(21) Appl. No.: 15/091,807

(22) Filed: Apr. 6, 2016

(65) Prior Publication Data

US 2016/0298840 A1 Oct. 13, 2016

Related U.S. Application Data

(63) Continuation-in-part of application No. PCT/US2014/057075, filed on Sep. 23, 2014, and a continuation-in-part of application No. PCT/US2014/016632, filed on Feb. 14, 2014, and a (Continued)

(51) Int. Cl.

| | |
|---|---|
| ***F23D 17/00*** | (2006.01) |
| ***F23D 14/14*** | (2006.01) |
| ***F23D 14/32*** | (2006.01) |
| ***F23C 13/02*** | (2006.01) |
| ***F23C 13/06*** | (2006.01) |

(Continued)

(52) U.S. Cl.

CPC ..... *F23D 14/14* (2013.01); *F23C 13/02* (2013.01); *F23C 13/06* (2013.01); *F23C 99/001* (2013.01); *F23D 14/32* (2013.01); *F23D 14/70* (2013.01); *F23C 2203/20* (2013.01); *F23D 2208/10* (2013.01)

(58) Field of Classification Search

CPC ..... F23D 17/002; F23D 14/14

See application file for complete search history.

(56) References Cited

U.S. PATENT DOCUMENTS

| | | | |
|---|---|---|---|
| 2,095,065 | A | 10/1937 | Hays |
| 3,324,924 | A | 6/1967 | Hailstone et al. |
| 3,847,536 | A | 11/1974 | Lepage |

(Continued)

FOREIGN PATENT DOCUMENTS

| | | |
|---|---|---|
| CH | 363428 | 7/1962 |
| CN | 101046304 | 10/2007 |

(Continued)

OTHER PUBLICATIONS

EPO Extended Search Report and Search Opinion of EP Application No. 14845529.8 dated Jul. 10, 2017.

(Continued)

*Primary Examiner* — Avinash A Savani
*Assistant Examiner* — Rabeeul I Zuberi
(74) *Attorney, Agent, or Firm* — Christopher A. Wiklof; Nicholas S. Bromer; Launchpad IP, Inc.

(57) ABSTRACT

A horizontally-fired flame burner includes a flame holder positioned laterally from the burner. The flame holder includes a plurality of perforations that collectively confine a combustion reaction of the burner to the flame holder.

32 Claims, 10 Drawing Sheets

Related U.S. Application Data continuation-in-part of application No. PCT/US2014/016622, filed on Feb. 14, 2014.

(60) Provisional application No. 61/931,407, filed on Jan. 24, 2014, provisional application No. 61/887,741, filed on Oct. 7, 2013, provisional application No. 61/765,022, filed on Feb. 14, 2013.

(51) Int. Cl.
*F23C 99/00* (2006.01)
*F23D 14/70* (2006.01)

(56) References Cited

U.S. PATENT DOCUMENTS

| | | | | |
|---|---|---|---|---|
| 4,021,188 | A | 5/1977 | Yamagishi et al. | |
| 4,081,958 | A | 4/1978 | Schelp | |
| 4,397,356 | A | 8/1983 | Retallick | |
| 4,483,673 | A | 11/1984 | Murai et al. | |
| 4,588,373 | A | 5/1986 | Tonon et al. | |
| 4,643,667 | A | 2/1987 | Fleming | |
| 4,673,349 | A | 6/1987 | Abe et al. | |
| 4,676,737 | A | 6/1987 | Suzuki et al. | |
| 4,726,767 | A | 2/1988 | Nakajima | |
| 4,752,213 | A * | 6/1988 | Grochowski | F23D 14/02 431/328 |
| 4,773,847 | A * | 9/1988 | Shukla | F23D 11/36 136/208 |
| 4,850,862 | A | 7/1989 | Bjerklie | |
| 5,235,667 | A | 8/1993 | Canfield et al. | |
| 5,248,255 | A | 9/1993 | Morioka et al. | |
| 5,326,257 | A | 7/1994 | Taylor et al. | |
| 5,375,999 | A | 12/1994 | Aizawa et al. | |
| 5,409,375 | A | 4/1995 | Butcher | |
| 5,439,372 | A | 8/1995 | Duret et al. | |
| 5,667,374 | A | 9/1997 | Nutcher et al. | |
| 5,718,573 | A | 2/1998 | Knight et al. | |
| 5,890,886 | A | 4/1999 | Doker et al. | |
| 5,899,686 | A | 5/1999 | Carbone et al. | |
| 5,993,192 | A | 11/1999 | Schmidt et al. | |
| 6,162,049 | A | 12/2000 | Pellizzari et al. | |
| 6,270,336 | B1 * | 8/2001 | Terashima | F23C 6/04 431/328 |
| 6,997,701 | B2 | 2/2006 | Volkert et al. | |
| 7,360,506 | B2 | 4/2008 | Shellenberger et al. | |
| 9,377,190 | B2 | 6/2016 | Karkow et al. | |
| 9,388,981 | B2 | 7/2016 | Karkow et al. | |
| 2002/0155403 | A1 | 10/2002 | Griffin et al. | |
| 2003/0054301 | A1 * | 3/2003 | Borders | F23D 14/22 431/8 |
| 2003/0054313 | A1 | 3/2003 | Rattner et al. | |
| 2004/0058290 | A1 | 3/2004 | Mauzey et al. | |
| 2004/0081933 | A1 | 4/2004 | St. Charles et al. | |
| 2005/0153252 | A1 * | 7/2005 | Crawley | F01N 3/025 431/5 |
| 2006/0084017 | A1 * | 4/2006 | Huebner | F23C 99/006 431/7 |
| 2006/0141413 | A1 * | 6/2006 | Masten | F23D 14/16 431/328 |
| 2007/0037104 | A1 * | 2/2007 | Musa | B01D 53/34 431/5 |
| 2007/0190470 | A1 * | 8/2007 | Gartz | F23N 5/082 431/6 |
| 2008/0124666 | A1 | 5/2008 | Stocker et al. | |
| 2009/0053664 | A1 | 2/2009 | Staller et al. | |
| 2010/0178219 | A1 | 7/2010 | Verykios et al. | |
| 2011/0044868 | A1 | 2/2011 | Lee et al. | |
| 2011/0194998 | A1 | 8/2011 | Kim et al. | |
| 2012/0116589 | A1 | 5/2012 | Schneider et al. | |
| 2012/0164590 | A1 | 6/2012 | Mach | |
| 2012/0247444 | A1 * | 10/2012 | Sherrow | F24H 9/14 126/116 R |
| 2015/0118629 | A1 | 4/2015 | Colannino et al. | |
| 2015/0276217 | A1 | 10/2015 | Karkow et al. | |
| 2015/0276220 | A1 | 10/2015 | Karkow et al. | |
| 2015/0285491 | A1 | 10/2015 | Karkow et al. | |
| 2015/0316261 | A1 | 11/2015 | Karkow et al. | |
| 2015/0330625 | A1 | 11/2015 | Karkow et al. | |
| 2015/0362177 | A1 | 12/2015 | Krichtafovitch et al. | |
| 2015/0362178 | A1 | 12/2015 | Karkow et al. | |
| 2015/0369477 | A1 | 12/2015 | Karkow et al. | |
| 2016/0003471 | A1 | 1/2016 | Karkow et al. | |
| 2016/0018103 | A1 | 1/2016 | Karkow et al. | |
| 2016/0025333 | A1 | 1/2016 | Karkow et al. | |
| 2016/0025374 | A1 | 1/2016 | Karkow et al. | |
| 2016/0025380 | A1 | 1/2016 | Karkow et al. | |
| 2016/0046524 | A1 | 2/2016 | Colannino et al. | |
| 2016/0091200 | A1 | 3/2016 | Colannino et al. | |
| 2016/0230984 | A1 | 8/2016 | Colannino | |

FOREIGN PATENT DOCUMENTS

| | | |
|---|---|---|
| CN | 103256707 | 8/2013 |
| EP | 0415008 | 3/1991 |
| EP | 0844434 | 5/1998 |
| JP | 60-073242 | 4/1985 |
| JP | 06-026624 | 2/1994 |
| JP | 07-083076 | 3/1995 |
| JP | 2006-275482 | 10/2006 |
| WO | WO 1995/000803 | 1/1995 |
| WO | 2014/127305 | 8/2014 |
| WO | 2015/054323 | 4/2015 |
| WO | 2015/061760 | 4/2015 |
| WO | 2015/070188 | 5/2015 |
| WO | 2015/112950 | 7/2015 |
| WO | 2015/123149 | 8/2015 |
| WO | 2015/123381 | 8/2015 |
| WO | 2015/123670 | 8/2015 |
| WO | 2015/123683 | 8/2015 |
| WO | 2015/123694 | 8/2015 |
| WO | 2015/123696 | 8/2015 |
| WO | 2015/123701 | 8/2015 |
| WO | 2016/007564 | 1/2016 |

OTHER PUBLICATIONS

Howell, J.R., et al.; "Combustion of Hydrocarbon Fuels Within Porous Inert Media," Dept. of Mechanical Engineering, The University of Texas at Austin. Prog. Energy Combust. Sci., 1996, vol. 22, p. 121-145.

PCT International Search Report and Written Opinion dated May 26, 2014 for International Patent Application No. PCT/US2014/016632 filed Feb. 14, 2014.

PCT International Search Report and Written Opinion dated May 27, 2014 for International Patent Application No. PCT/US2014/016622 filed Feb. 14, 2014.

PCT International Search Report and Written Opinion of PCT Application No. PCT/US2014/057075 dated Jan. 14, 2015.

Fric, Thomas F., "Effects of Fuel-Air Unmixedness on NOx Emissions," Sep.-Oct. 1993. Journal of Propulsion and Power, vol. 9, No. 5, pp. 708-713.

Arnold Schwarzenegger, "A Low NOx Porous Ceramics Burner Performance Study," California Energy Commission Public Interest Energy Research Program, Dec. 2007, San Diego State University Foundation, p. 5.

* cited by examiner

HORIZONTALLY FIRED BURNER WITH A PERFORATED FLAME HOLDER

CROSS REFERENCE TO RELATED APPLICATIONS

The present application is a U.S. Continuation-in-Part Application which claims priority benefit under 35 U.S.C. § 120 (pre-AIA) of co-pending International Patent Application No. PCT/US2014/057075, entitled "HORIZONTALLY-FIRED BURNER WITH A PERFORATED FLAME HOLDER," filed Sep. 23, 2014, which application claims priority benefit from U.S. Provisional Patent Application No. 61/887,741, entitled "POROUS FLAME HOLDER FOR LOW NOx COMBUSTION," filed Oct. 7, 2013; and the present application is a U.S. Continuation-in-Part Application which claims priority benefit under 35 U.S.C. § 120 (pre-AIA) of co-pending International Patent Application No. PCT/US2014/016632, entitled "FUEL COMBUSTION SYSTEM WITH A PERFORATED REACTION HOLDER," filed Feb. 14, 2014, which application claims priority benefit from U.S. Provisional Patent Application No. 61/931,407, entitled "LOW NOx FIRE TUBE BOILER," filed Jan. 24, 2014, and U.S. Provisional Patent Application No. 61/765,022, entitled "PERFORATED FLAME HOLDER AND BURNER INCLUDING A PERFORATED FLAME HOLDER," filed Feb. 14, 2013; and the present application is a U.S. Continuation-in-Part Application which claims priority benefit under 35 U.S.C. § 120 (pre-AIA) of co-pending International Patent Application No. PCT/US2014/016622, entitled "STARTUP METHOD AND MECHANISM FOR A BURNER HAVING A PERFORATED FLAME HOLDER," filed Feb. 14, 2014, which application claims priority benefit from U.S. Provisional Patent Application No. 61/765,022, entitled "PERFORATED FLAME HOLDER AND BURNER INCLUDING A PERFORATED FLAME HOLDER," filed Feb. 14, 2013, and U.S. Provisional Patent Application No. 61/931,407, entitled "LOW NOx FIRE TUBE BOILER," filed Jan. 24, 2014; each of which, to the extent not inconsistent with the disclosure herein, is incorporated herein by reference.

SUMMARY

One embodiment is a horizontally-fired flame reactor including a perforated flame holder and a horizontally-fired fuel nozzle positioned laterally from the perforated flame holder. The perforated flame holder includes an input surface facing the fuel nozzle, an output surface, and a plurality of perforations extending between the input and output surfaces. A heating mechanism is positioned adjacent the perforated flame holder.

In one embodiment the heating mechanism applies heat to the perforated flame holder before the fuel nozzle outputs fuel onto the perforated flame holder. After the heating mechanism heats the perforated flame holder, the horizontally-fired fuel nozzle outputs fuel onto the perforated flame holder. The elevated temperature of the perforated flame holder causes a combustion reaction of the fuel within the perforations of the flame holder. The combustion reaction is confined primarily to the immediate vicinity of the perforated flame holder.

In one embodiment the horizontally-fired flame reactor includes a catalyst packed tube positioned adjacent the perforated flame holder. A reactant is passed through the tube. Heat from the combustion reaction radiates from the flame holder and heats the tube, thereby causing the reactant to react with the catalyst. A reaction product is then passed from the tube.

DETAILED DESCRIPTION

Figure 1:
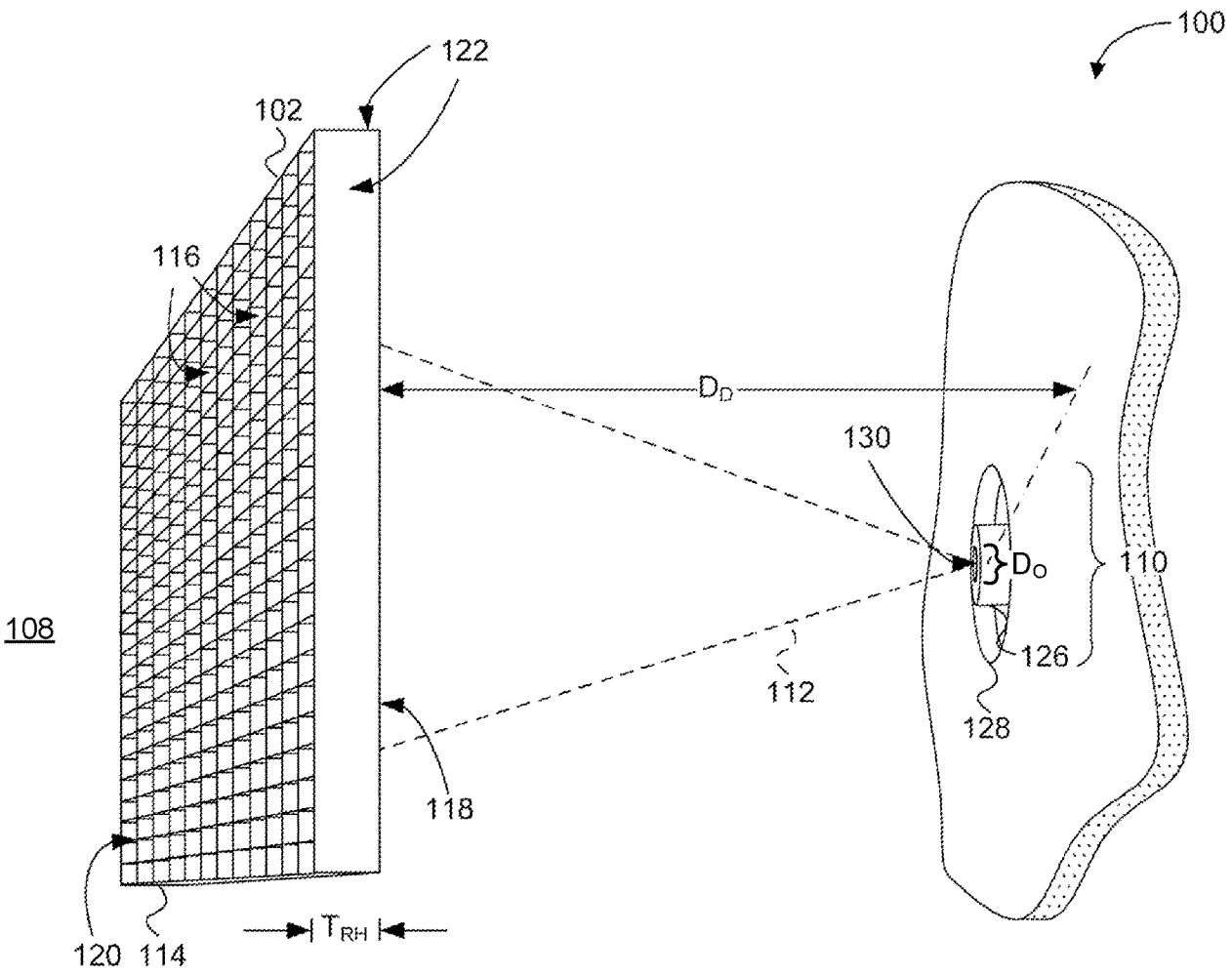
FIG. 1 is a perspective view of a horizontally-fired burner system including a perforated flame holder, according to one embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 is a simplified perspective view of a horizontally-fired burner system 100 including a perforated flame holder 102, according to an embodiment. The horizontally-fired burner system 100 includes a fuel and oxidant source 110 disposed to output fuel and oxidant into a combustion volume 108 to form a fuel and oxidant mixture 112. The perforated flame holder 102 is disposed in the combustion volume 108. The perforated flame holder 102 includes a perforated flame holder body 114 defining a plurality of perforations 116 aligned to receive the fuel and oxidant mixture 112 from the fuel and oxidant source 110. The perforations 116 are configured to collectively hold a combustion reaction (e.g., see FIG. 2, 208) supported by the fuel and oxidant mixture 112.

The fuel can include a hydrocarbon gas or a vaporized hydrocarbon liquid, for example. The fuel can be a single species or can include a mixture of gases and vapors. For example in a process heater application, the fuel can include fuel gas or byproducts from the process that include carbon monoxide (CO), hydrogen ($H_2$), and methane ($CH_4$). In another application the fuel can include natural gas (mostly $CH_4$) or propane. In another application, the fuel can include #2 fuel oil or #6 fuel oil. Dual fuel applications and flexible fuel applications are similarly contemplated by the inventors. The oxidant can include oxygen carried by air and/or can include another oxidant, either pure or carried by a carrier gas.

Generally, the oxidation reaction held by the perforated flame holder 102 is indicative of a gas phase oxidation reaction. Other reactants and reactions may be substituted without departing from the spirit and scope of the disclosure.

According to an embodiment, the perforated flame holder body 114 can be bounded by an input surface 118 disposed to receive the fuel and oxidant mixture 112, an output surface 120 facing away from the fuel and oxidant source 110, and a peripheral surface 122. The plurality of perforations 116 defined by the perforated flame holder body 114 extend from the input surface 118 to the output surface 120.

According to an embodiment, the perforated flame holder 102 is configured to hold a majority of a combustion reaction within the perforations 116. For example, this means that more than half the molecules of fuel output into the combustion volume 108 by the fuel and oxidant source 110 are converted to combustion products between the input surface 118 and the output surface 120 of the perforated flame holder 102. According to an alternative interpretation, this means that more than half of the heat output by the combustion reaction is output between the input surface 118 and the output surface 120 of the perforated flame holder 102. Under nominal operating conditions, the perforations 116 can be configured to collectively hold at least 80% of the combustion reaction 208 (see FIG. 2) between the input surface 118 and the output surface 120 of the perforated flame holder 102. In some experiments, the inventors produced a combustion reaction that was wholly contained in the perforations between the input surface 118 and the output surface 120 of the perforated flame holder 102.

The perforated flame holder 102 can be configured to receive heat from the combustion reaction and output a portion of the received heat as thermal radiation 124 (see FIG. 2) to heat-receiving structures (e.g., furnace walls and/or radiant section working fluid tubes (see. FIG. 3)) in or adjacent to the combustion volume 108. The perforated flame holder 102 outputs another portion of the received heat to the fuel and oxidant mixture 112 received at the input surface 118 of the perforated flame holder 102.

In this way, the perforated flame holder 102 acts as a heat source to maintain the combustion reaction, even under conditions where a combustion reaction would not be stable when supported from a conventional flame holder. This capability can be leveraged to support combustion using a leaner fuel to oxidant mixture than was previously feasible. Leaner combustion results in lower peak combustion temperature and reduces oxides of nitrogen (NOx) output. Moreover, the perforated flame holder 102 may act as a heat sink to cool hotter parts of the reaction to further minimize combustion temperature. Finally, substantial containment of the combustion reaction between the input surface 118 and the output surface 120 of the perforated flame holder 102 limits the time during which the combustion fluid (including molecular nitrogen, $N_2$, if the oxidant includes oxygen carried by air) is exposed to high temperature. The inventors believe this further limits NOx output.

Cooled flue gas is vented to the atmosphere through an exhaust flue. Optionally, the vented flue gas can pass through an economizer that pre-heats the combustion air, the fuel, and/or feed water.

The perforated flame holder 102 can have a width dimension $W_{RH}$ between opposite sides of the peripheral surface 122 at least twice a thickness dimension $T_{RH}$ between the input surface 118 and the output surface 120. In another embodiment, the perforated flame holder 102 can have a width dimension $W_{RH}$ between opposite sides of the peripheral surface 122 at least three times a thickness dimension $T_{RH}$ between the input surface 118 and the output surface 120. In another embodiment, the perforated flame holder 102 has a width dimension $W_{RH}$ between opposite sides of the peripheral surface 122 at least six times a thickness dimension $T_{RH}$ between the input surface 118 and the output surface 120. In another embodiment, the perforated flame holder 102 has a width dimension $W_{RH}$ between opposite sides of the peripheral surface 122 at least nine times a thickness dimension $T_{RH}$ between the input surface 118 and the output surface 120.

In an embodiment, the perforated flame holder 102 can have a width dimension $W_{RH}$ less than a width W of the combustion volume 108. This can allow circulation of flue gas around the perforated flame holder 102.

The perforated flame holder 102 can be formed from a refractory material. In another embodiment, the perforated flame holder 102 can be formed from an aluminum silicate material. In another embodiment, the perforated flame holder 102 can be formed from mullite or cordierite.

The fuel and oxidant source 110 can further include a fuel nozzle 126 configured to output fuel and an oxidant source 128 configured to output a fluid including the oxidant. The fuel nozzle 126 can be configured to output pure fuel. The oxidant source 128 can be configured to output fluid including the oxidant that includes no fuel. For example, the oxidant source 128 can be configured to output air carrying oxygen.

The fuel nozzle 126 can be configured to emit a fuel jet selected to entrain the oxidant to form the fuel and oxidant mixture 112 as the fuel jet and oxidant travel through a dilution distance $D_D$ between the fuel nozzle 126 and the perforated flame holder 102. Additionally or alternatively, the fuel nozzle 126 can be configured to emit a fuel jet selected to entrain the oxidant and to entrain flue gas as the fuel jet travels through a dilution distance $D_D$ between the fuel nozzle 126 and an input surface 118 of the perforated flame holder 102.

The perforated flame holder 102 can be disposed a distance $D_D$ away from the fuel nozzle. The fuel nozzle 126 can be configured to emit the fuel through a fuel orifice 130 having a dimension $D_O$. The perforated flame holder 102 can be disposed to receive the fuel and oxidant mixture 112 at a distance $D_D$ away from the fuel nozzle greater than 20 times the fuel orifice 130 dimension $D_O$. In another embodiment, the perforated flame holder 102 is disposed to receive the fuel and oxidant mixture 112 at a distance $D_D$ away from the fuel nozzle 126 greater than or equal to 100 times the fuel orifice dimension $D_O$. In another embodiment the perforated flame holder 102 can be disposed to receive the fuel and oxidant mixture 112 at a distance $D_D$ away from the fuel nozzle 126 equal to about 245 times the fuel orifice dimension $D_O$.

The perforated flame holder 102 can include a single perforated flame holder body 114. In another embodiment, the perforated flame holder 102 can include a plurality of adjacent perforated flame holder sections. The plurality of adjacent perforated flame holder bodies 114 can provide a tiled perforated flame holder 102.

The perforated flame holder 102 can further include a perforated flame holder tile support structure configured to support the plurality of perforated flame holder sections. The perforated flame holder tile support structure can include a metal superalloy. In another embodiment, the plurality of adjacent perforated flame holder sections can be joined with a fiber reinforced refractory cement.

Figure 2:
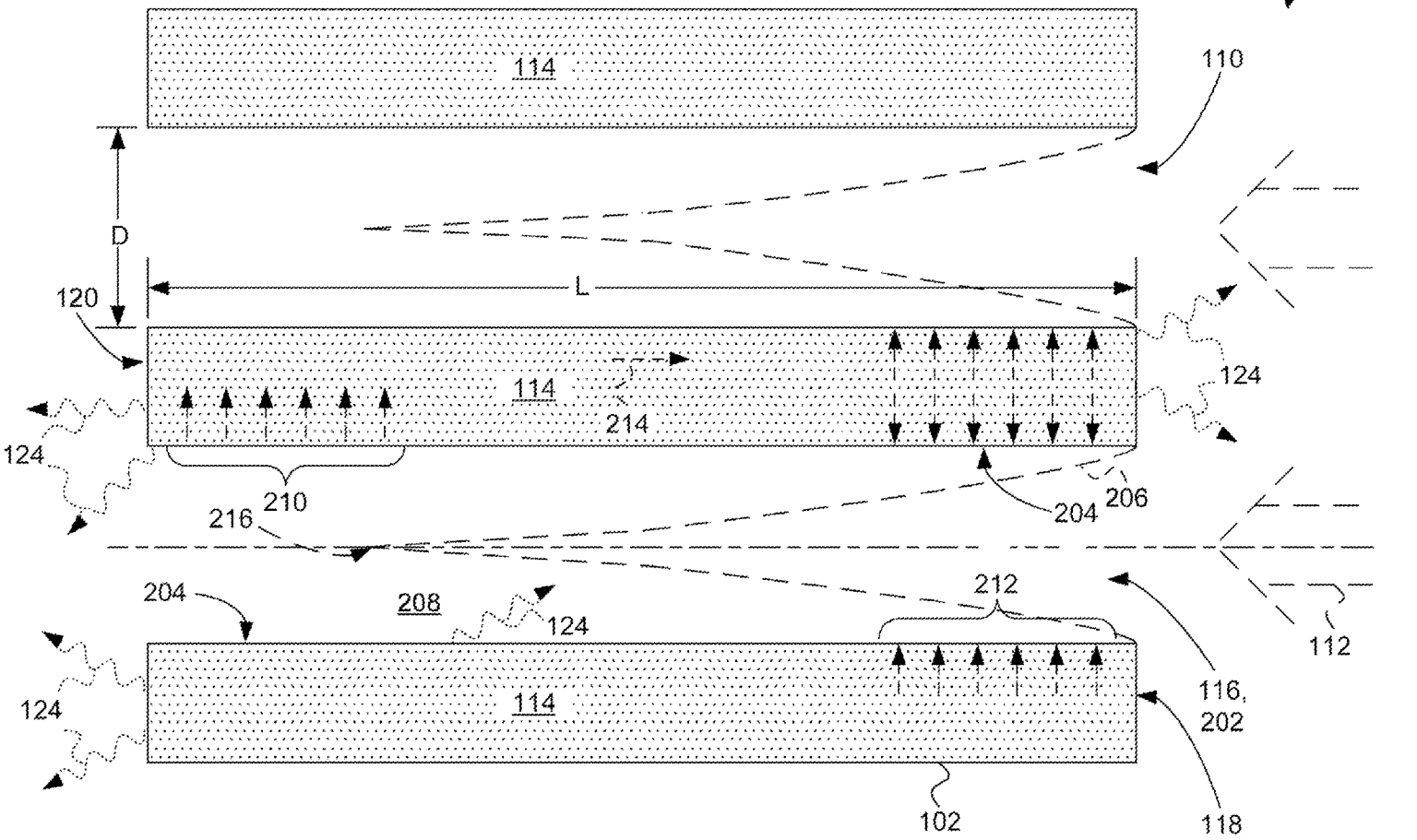
FIG. 2 is a cross sectional view of the horizontally-fired burner system of FIG. 1, according to one embodiment.
Figure 3:
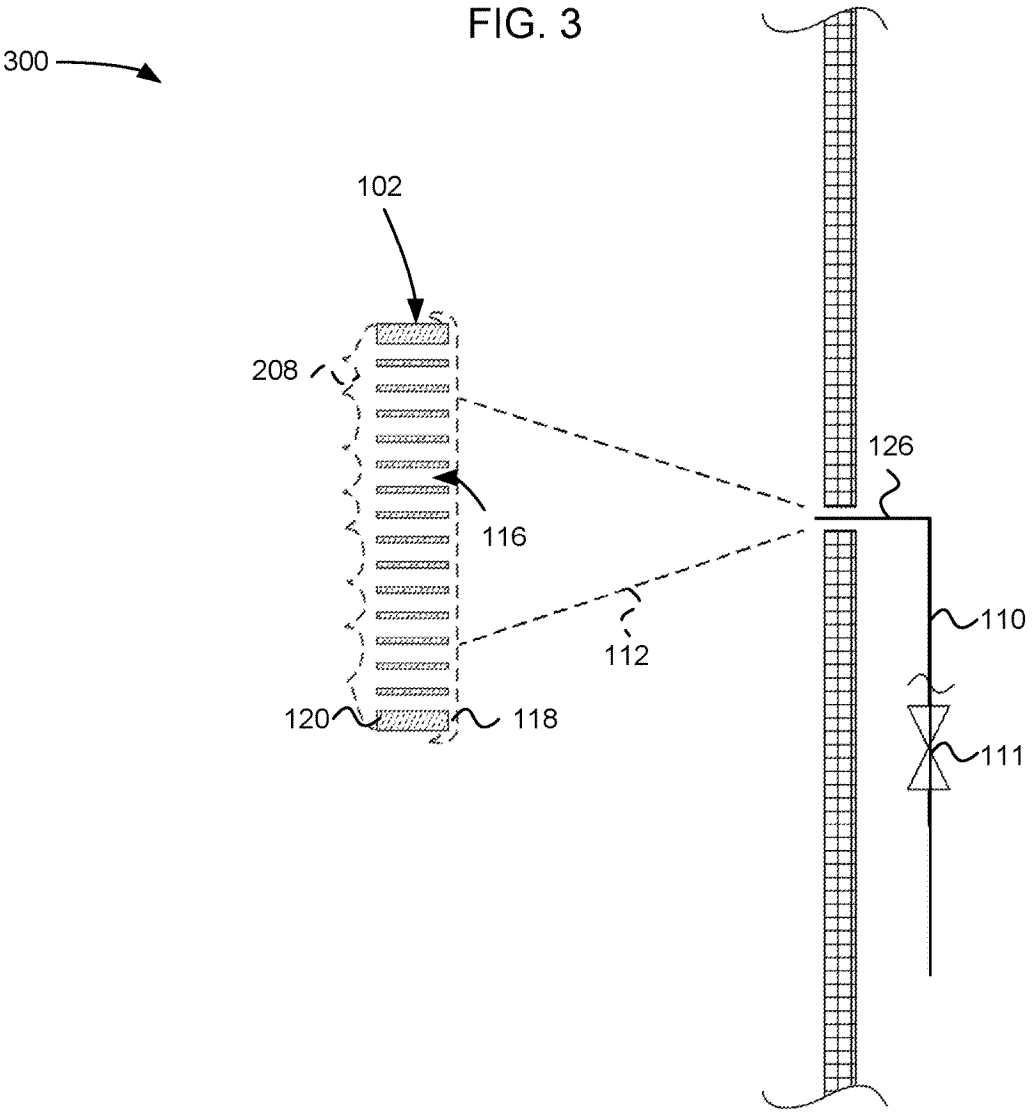
FIG. 3 is a diagram of horizontally-fired burner system including a perforated flame holder, according to one embodiment.

FIG. 2 is side sectional diagram of a portion of the perforated flame holder 102 of FIG. 1, according to an embodiment 200. In the embodiment 200 of FIG. 2, the perforated flame holder body 114 is continuous. That is, the body 114 is formed from a single piece of material. The embodiment 200 of FIG. 2 also illustrates perforations 116 that are non-branching. That is, the perforated flame holder body 114 defines perforations 116 that are separated from one another such that no flow crosses between perforations.

In an alternative embodiment the perforated flame holder body 114 defines perforations that are non-normal to the input and output surfaces 118, 120. While this arrangement has an effect on gas trajectory exiting the output surface 120, the perforations operate similarly to those described in conjunction with FIG. 2.

Referring now to FIG. 2, the perforated flame holder body 114 defines a plurality of perforations 116 configured to convey the fuel and oxidant and to hold the oxidation reaction 208 supported by the fuel and oxidant. The body is configured to receive heat from the combustion reaction 208, hold the heat, and output the heat to the fuel and oxidant entering the perforations 116. The perforations 116 can maintain a combustion reaction 208 of a leaner mixture of fuel and oxidant 112 than is maintained outside of the perforations 116.

The perforated flame holder 102 has an extent defined by an input surface 118 facing the fuel and oxidant source 110 and the output surface 120 facing away from the fuel and oxidant source 110. The perforated flame holder body 114 defines the plurality of perforations 116 that can be formed as a plurality of elongated apertures 202 extending from the input surface 118 to the output surface 120.

The perforated flame holder 102 receives heat from the combustion reaction 208 and outputs sufficient heat to the fuel and oxidant mixture 112 to maintain the combustion reaction 208 in the perforations 116. The perforated flame holder 102 can also output a portion of the received heat as thermal radiation 124 to combustor walls of the combustion volume 108 (see FIG. 1). Each of the perforations 116 can bound a respective finite portion of the fuel combustion reaction 208.

In an embodiment, the plurality of perforations 116 are each characterized by a length L defined as a reaction fluid propagation path length between the input surface 118 and the output surface 120 of the perforated flame holder 102. The reaction fluid includes the fuel and oxidant mixture 112 (optionally including air, flue gas, and/or other "non-reactive" species, reaction intermediates (including transition states that characterize the combustion reaction), and reaction products)).

The plurality of perforations 116 can be each characterized by a transverse dimension D between opposing perforation walls 204. The length L of each perforation 116 can be at least eight times the transverse dimension D of the perforation. In another embodiment, the length L can be at least twelve times the transverse dimension D. In another embodiment, the length L can be at least sixteen times the transverse dimension D. In another embodiment, the length L can be at least twenty-four times the transverse dimension D. The length L can be sufficiently long for thermal boundary layers 206 formed adjacent to the perforation walls 204 in a reaction fluid flowing through the perforations 116 to converge within the perforations 116, for example.

According to an embodiment, the perforated flame holder 102 can be configured to cause the fuel combustion reaction 208 to occur within thermal boundary layers 206 formed adjacent to perforation walls 204 of the perforations 116. As relatively cool fuel and oxidant 112 approach the input surface 118, the flow is split into portions that respectively travel through individual perforations 116. The hot perforated flame holder body 114 transfers heat to the fluid, notably within thermal boundary layer 206 that progressively thicken as more and more heat is transferred to the incoming fuel and oxidant. After reaching a combustion temperature, the reactants flow while a chemical ignition delay time elapses, after which the combustion reaction occurs. Accordingly, the combustion reaction 208 is shown as occurring within the thermal boundary layers 206. As flow progresses, the thermal boundary layers 206 merge at a point 216. Ideally, the point 216 lies between the input surface 118 and output surface 120. At some point, the combustion reaction 208 causes the flowing gas (and plasma) to output more heat than it receives from the body 114. The received heat, from a region 210, is carried to a region 212 nearer to the input surface 118, where the heat recycles into the cool reactants.

The perforations 116 can include elongated squares, each of the elongated squares has a transverse dimension D between opposing sides of the squares. In another embodiment, the perforations 116 can include elongated hexagons, each of the elongated hexagons has a transverse dimension D between opposing sides of the hexagons. In another embodiment, the perforations 116 can include hollow cylinders, each of the hollow cylinders has a transverse dimension D corresponding to a diameter of the cylinders. In another embodiment, the perforations 116 can include truncated cones, each of the truncated cones has a transverse dimension D that is rotationally symmetrical about a length axis that extends from the input surface 118 to the output surface 120. The perforations 116 can each have a lateral dimension D equal to or greater than a quenching distance of the fuel.

In one range of embodiments, the plurality of perforations have a lateral dimension D between 0.05 inch and 1.0 inch. Preferably, the plurality of perforations have a lateral dimension D between 0.1 inch and 0.5 inch. For example the plurality of perforations can have a lateral dimension D of about 0.2 to 0.4 inch.

The perforated flame holder body 114 can include a refractory material. The perforated flame holder body 114 can include a metal superalloy, for example, or the perforated flame holder body can be formed from a refractory material such as cordierite or mullite, for example. The perforated flame holder body 114 can define a honeycomb.

The perforations 116 can be parallel to one another and normal to the input and output surfaces 118, 120. In another embodiment, the perforations 116 can be parallel to one another and formed at an angle relative to the input and output surfaces 118, 120. In another embodiment, the perforations 116 can be non-parallel to one another. In another embodiment, the perforations 116 can be non-parallel to one another and non-intersecting.

Referring still to FIG. 2, the perforated flame holder body 114 defining the perforations 116 can be configured to receive heat from the (exothermic) combustion reaction 208 at least in second regions 210 of perforation walls 204. (e.g., near the output surface 120 of the perforated flame holder 102). The perforated flame holder body 114 defining the perforations 116 can be characterized by a heat capacity. The perforated flame holder body 114 can be configured to hold heat from the combustion reaction 208 in an amount corresponding to the heat capacity.

The perforated flame holder body 114 can be configured to transfer heat from the heat-receiving regions 210 to heat output regions 212 of the perforation walls 204. (e.g., wherein the heat-output regions 212 are near the input surface 118 of the perforated flame holder 102). For example, the perforated flame holder body 114 can be configured to transfer heat from the heat-receiving regions 210 to the heat-output regions 212 of the perforation walls 204 via thermal radiation 124. Additionally or alternatively, the body 114 can be configured to transfer heat from the heat-receiving regions 210 to the heat-output regions 212 of the perforation walls 204 via a heat conduction path 214.

In another embodiment, the perforated flame holder body 114 can be configured to transfer heat to a working fluid. The working fluid can be configured to transfer heat from a portion of the body near the heat-receiving regions 210 of the perforation walls 204 to a portion of the body 114 near the heat-output regions 212 of the perforation walls 204.

The perforated flame holder body 114 can be configured to output heat to the boundary layers 206 at least in heat-output regions 212 of perforation walls 204 (e.g., near the input surface 118 of the perforated flame holder 102). Additionally or alternatively, the body 114 can be configured to output heat to the fuel and oxidant mixture 112 at least in heat-output regions 212 of perforation walls 204 (e.g., near the input surface 118 of the perforated flame holder 102) wherein the perforated flame holder body 114 is configured to convey heat between adjacent perforations 116. The heat conveyed between adjacent perforations can be selected to cause heat output from the combustion reaction portion in a perforation 116 to supply heat to stabilize the combustion reaction portion in an adjacent perforation 116.

The perforated flame holder body 114 can be configured to receive heat from the fuel combustion reaction 208 and output thermal radiation 124 to maintain a temperature of the perforated flame holder body 114 below an adiabatic flame temperature of the fuel combustion reaction 208. Additionally or alternatively, the body can be configured to receive heat from the fuel combustion reaction 208 to cool the fuel combustion reaction 208 to a temperature below a NOx formation temperature.

The plurality of perforations 116 can include a plurality of elongated squares. In another embodiment, the plurality of perforations 116 can include a plurality of elongated hexagons.

Honeycomb shapes used in the perforated flame holder 102 can be formed from VERSAGRID® ceramic honeycomb, available from Applied Ceramics, Inc. of Doraville, S.C.

As described above, FIG. 2 illustrates an embodiment 200 wherein the perforated flame holder body 114 is continuous. A continuous flame holder body 114 is, within any one section, a single piece that is extruded, drilled, or otherwise formed to define the plurality of perforations 116. However, in one embodiment the perforated flame holder body 114 is discontinuous. A discontinuous flame holder body 114 is formed from a plurality of pieces of material. In the embodiment 201 (not shown), the plurality of pieces of material comprises planar pieces that are stacked to form the flame holder body. The embodiments 200 and 201 operate substantially identically in that the individual stacked pieces are intimately contacting and form perforations 116 that are separated from one another.

FIG. 3 is a simplified illustration of a horizontally-fired flame reactor 300, according to one embodiment. The horizontally-fired flame reactor 300 includes a fuel and oxidant source 110 coupled to a horizontally-fired fuel nozzle 126. A control valve 111 controls the flow of fuel to the horizontally-fired fuel nozzle 126. A perforated flame holder 102 is positioned laterally from the horizontally-fired fuel nozzle 126.

The horizontally-fired fuel nozzle 126 emits one or more pressurized fuel jets horizontally, in a direction substantially in opposition to flame buoyancy. The fuel contacts the perforated flame holder 102, which in one embodiment has been preheated, and a combustion reaction 208 of the fuel is initiated within the perforated flame holder 102 as described previously. According to embodiments, the horizontally-fired fuel nozzle 126 is a horizontally facing fuel nozzle configured to output fuel in a horizontal direction.

In one embodiment the fuel nozzle 126 protrudes much further into the heating volume, closer to perforated flame holder 102, in order to maintain momentum of the fuel stream. While the fuel nozzle 126 is not illustrated with particular detail in FIG. 3, those of skill the art will understand that many configurations of the fuel nozzle are possible in light of principles of the present disclosure. All such other configurations fall within the scope of the present disclosure. For example, the fuel nozzle 126 can include multiple individual apertures. A plurality of the apertures can output fuel while another plurality of the apertures can output oxygen or a gas containing oxygen, such as air. Thus the fuel stream 112 illustrated in FIG. 3 includes a mixture of oxygen and fuel.

In one embodiment 50% or more of the combustion reaction of the fuel is contained within the perforations 116 of the flame holder 102. Alternatively, 80% or more of the combustion reaction 208 can be contained within the perforations 116 of the flame holder 102.

While the perforated flame holder 102 has been shown in a particular position with respect to the nozzle 126, those skilled of the art will understand, in light of the present disclosure, that the perforated flame holder 102 can be positioned in various configurations with respect to the nozzle 126. Changes in position of the flame holder 102 can be accompanied by changes in fuel momentum to ensure that the combustion reaction 208 occurs within the flame holder 102. All such other configurations fall within the scope of the present disclosure.

Figure 4:
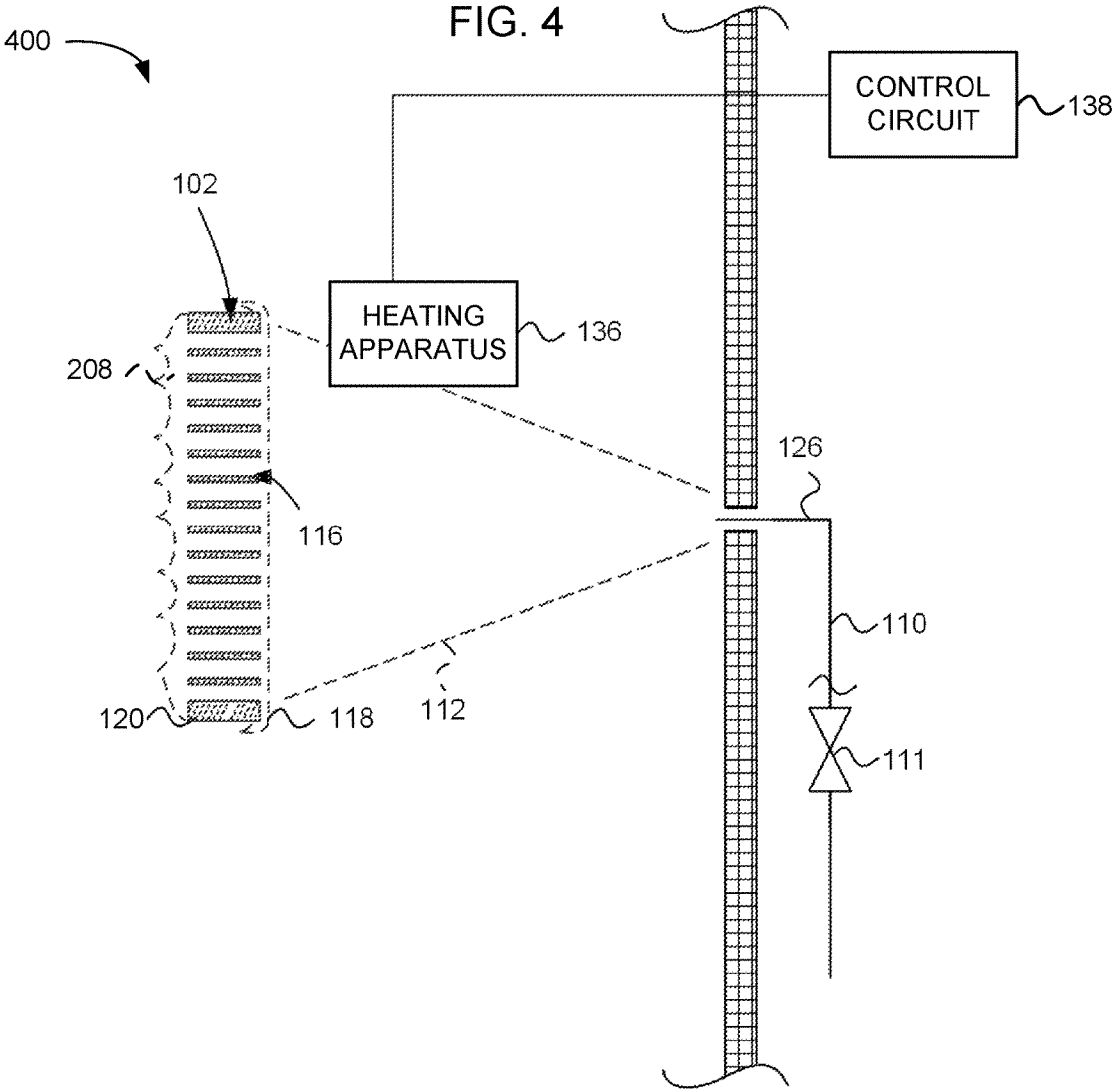
FIG. 4 is a block diagram of horizontally-fired burner system including a perforated flame holder and a preheating mechanism, according to one embodiment.

FIG. 4 is a block diagram of a horizontally-fired burner 400, according to one embodiment. The horizontally-fired burner of FIG. 4 is substantially similar to the horizontally-fired burner 300 of FIG. 3. The embodiment of FIG. 4 further includes a heating apparatus 136 positioned adjacent the perforated flame holder 102. The heating apparatus 136 is electrically coupled to a control circuit 138.

The heating apparatus 136 is configured to preheat the perforated flame holder 102 prior to outputting fuel from the nozzle 126 onto the perforated flame holder 102. In particular, in preparation for initiating a combustion reaction 208 of the fuel stream 112 in the perforated flame holder 102, fuel stream 112 is appreciated to a threshold temperature. The threshold temperature selected such that when the perforated flame holder 102 is heated to a threshold temperature, the combustion reaction 208 of the fuel stream 112 spontaneously begins when the fuel stream 112 contacts perforated flame holder 102. Heat from the combustion reaction 208 further increases the temperature of the perforated flame holder 102. In this manner a self-sustaining combustion reaction 208 can be initiated by merely preheating the perforated flame holder 102 to a threshold temperature and then outputting the fuel stream 112 onto the perforated flame holder 102.

Figure 5:
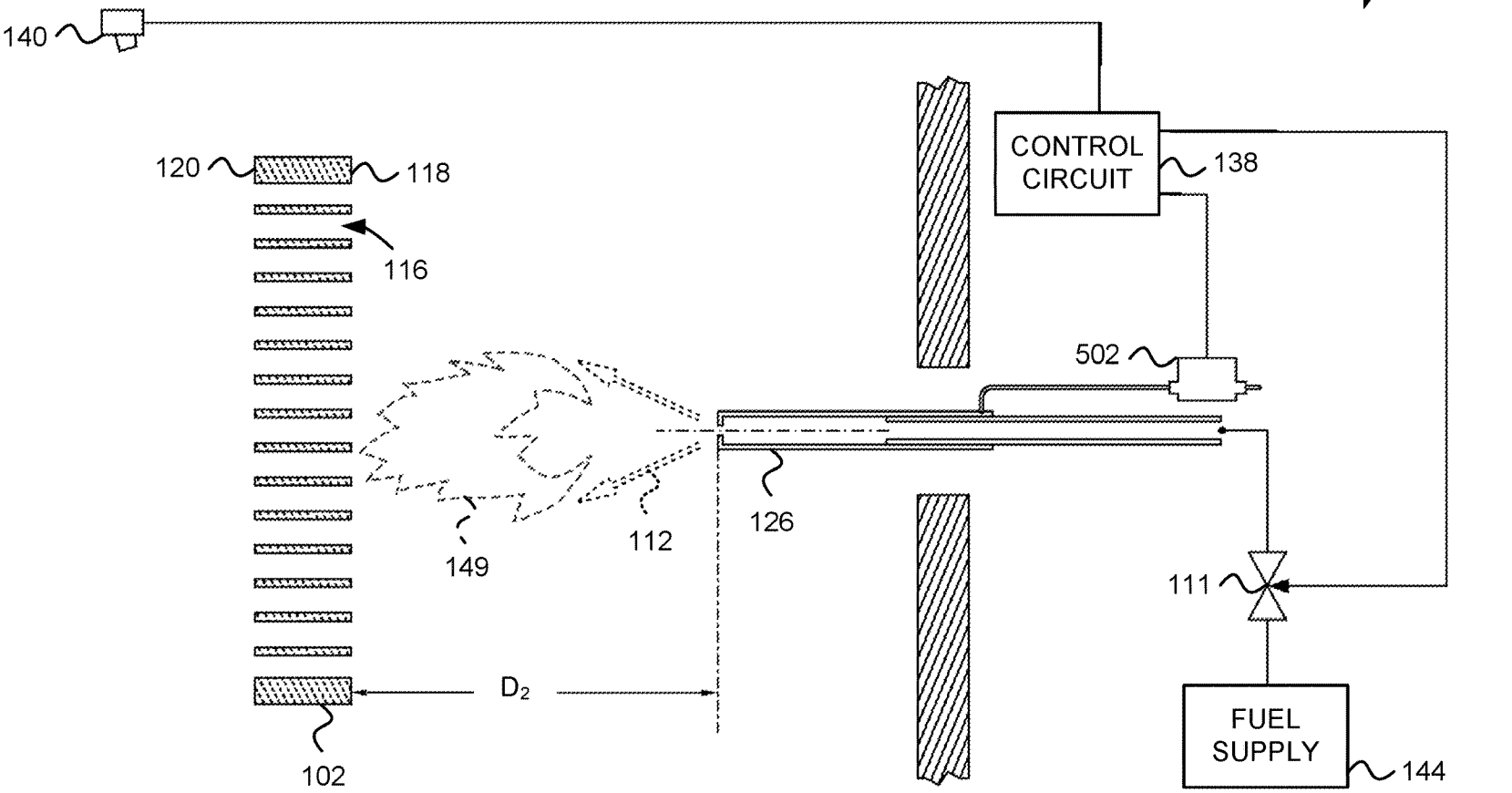
FIG. 5 is an illustration of a preheating mechanism of horizontally-fired burner system, according to one embodiment.

FIG. 5 is a block diagram of a horizontally-fired burner 500 including a heating apparatus 136, according to one embodiment. The preheating mechanism 136 is coupled to an adjustable fuel nozzle 126. A temperature sensor 140 is positioned adjacent the flame holder 102. A primary fuel valve 111 controls a flow of fuel from the fuel supply 144 to the fuel nozzle 126.

FIG. 5 shows the horizontally-fired burner 500 in startup mode, in which the fuel nozzle 126 is it is extended, i.e., startup position, in which the distance $D_2$ between the nozzle 126 and the perforated flame holder 102 is significantly reduced as compared to when the nozzle 126 is fully retracted. Additionally, the control circuit 138 controls the fuel control valve 111 to reduce the volume and velocity of the fuel stream 112 ejected by the nozzle 126. Because the velocity of the fuel stream 112 is reduced, a stable startup flame 149 can be supported by the nozzle 126, alone, in a position between the nozzle and the perforated flame holder 102. By moving the nozzle 126 to the extended position, the startup flame 149 is positioned close to the perforated flame holder 102, and is thus able to quickly heat a portion of the perforated flame holder 102 to a temperature that exceeds a threshold defining a minimum startup temperature (i.e., the startup temperature threshold) of the perforated flame holder 102. When the signal from the temperature sensor 140 indicates that the temperature of the perforated flame holder 102 is above the threshold, the system control circuit 138 controls a nozzle position controller 502 to move the nozzle 126 to the retracted, operational position, and controls the fuel control valve 111 to open further, increasing the fuel flow to an operational level. As the velocity of the fuel stream 112 increases, the startup flame 149 is blown out. As the uncombusted fuel mixture reaches the perforated flame holder 102, the mixture auto-ignites, at least within the portion of the perforated flame holder 102 that has been heated beyond the startup threshold. Very quickly thereafter, the entire perforated flame holder 102 is heated to its operating temperature, and continues in normal operation thereafter.

According to another embodiment, the system control circuit 138 includes a timer by which transition from startup mode to operational mode is controlled; i.e., when startup is initiated, the system control circuit 138 starts the timer, and when a selected time period has passed, the nozzle 126 is retracted and the fuel flow is increased, as described above. The time period is selected according to a predetermined period necessary to ensure that the perforated flame holder 102 has reached the startup temperature threshold.

The movable nozzle 126 can also be employed in combustion systems that may be required to operate on a variety of fuels. As is well known in the art, the fuel-to-air ratio at which the mixture is combustible varies according to the type of fuel, as does flame propagation speed within a flow of fuel. Thus, an optimal operating distance $D_2$ will vary according to the type of fuel. The horizontally-fired burner 500 can accommodate changes in fuel type by adjustment of the position of the nozzle 126 relative to the perforated flame holder 102. The adjustment can be made by direct manual control of the nozzle 126, or the system control circuit 138 can be programmed to make the adjustment automatically. For example, additional sensors can be positioned to detect emission levels of flames propagating within the fuel stream 112, incomplete combustion, etc., in response to which the system control unit can be programmed to modify the position of the nozzle 126 and/or the fuel flow by adjustment of the fuel control valve 111, to bring the operation of the system closer to an optimum or desired level.

Figure 6:
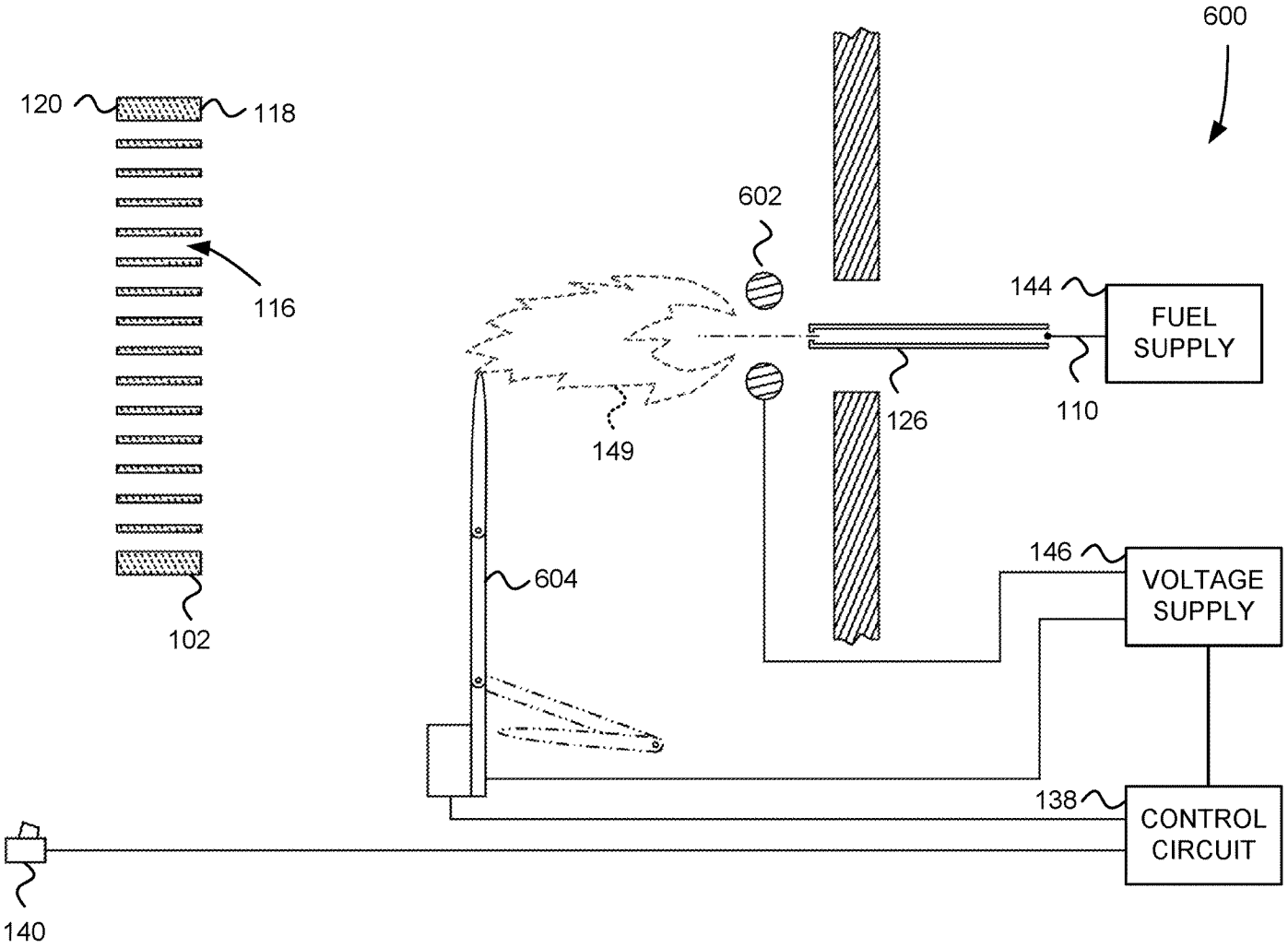
FIG. 6 is an illustration of a preheating mechanism of horizontally-fired burner system, according to one embodiment.

FIG. 6 is a diagrammatical side view of a horizontally-fired burners 600, according to an embodiment, portions of which are shown in section. The combustion system includes a first electrode 602 and second electrode 604 (which functions as a heating apparatus), both operatively coupled to a voltage supply 146. A control unit is coupled to the voltage supply 146 and a temperature sensor 140.

The first electrode 602 is in the shape of a torus, positioned just downstream of the nozzle 126 and centered on the longitudinal axis of the nozzle so that the fuel stream 112 passes through the first electrode 602. The second electrode 604 is positioned between the input end 118 of the perforated flame holder 102 and the nozzle 126. The second electrode 604 is movable from an extended position, as shown in solid lines in FIG. 6, to a retracted position, shown in phantom lines. The control circuit 138 is configured to extend and retract the second electrode 604. In the extended position, the second electrode 604 extends to a position close to or intersecting the longitudinal axis of the fuel nozzle 126. In the retracted position, the second electrode 604 is spaced away from contact with the fuel stream 112 or a flame supported thereby. According to an embodiment, a temperature sensor 140 is provided, as previously described.

In operation, when the combustion system 600 is in startup mode, i.e., when startup is initiated, the control circuit 138 causes the second electrode 604 to move to the extended position. The control circuit 138 controls the voltage supply 146 to transmit a first voltage signal to the first electrode 602. As the fuel stream 112 passes through the first electrode 602, an electrical charge having a first polarity is imparted to the fuel stream. Meanwhile, the control circuit 138 transmits a second voltage signal from the voltage supply 146 to the second electrode 604. The second voltage signal has a polarity that is opposite that of the charge imparted to the fuel stream, and therefore attracts the oppositely-charged fuel stream. Ignition is initiated within the fuel stream 112, whereupon a startup flame 149 is held between the first and second electrodes 602, 604, in spite of the high velocity of the fuel stream. This method of holding a flame within a fuel flow is sometimes referred to as electrodynamic combustion control.

According to an embodiment, the control circuit 138 controls the voltage supply 146 to apply a voltage signal to the second electrode 604 while connecting the first electrode 602 to ground. According to an embodiment, the voltage signal applied to the first and/or second electrode is an AC signal.

With the startup flame 149 held adjacent the input surface 118 of the perforated flame holder 102, a portion of the perforated flame holder 102 is quickly heated to the startup temperature threshold. When the startup temperature threshold is surpassed, the control circuit 138 controls the voltage supply 146 to remove the voltage signals from the first and second electrodes 602, 604, and causes the second electrode 604 to move to the retracted position. When the voltage signals are removed from the electrodes, the startup flame 149 is no longer held, and blows out. As previously described, when the uncombusted fuel and air mixture reaches the perforated flame holder 102, the primary flame auto-ignites in the preheated portions of the perforated flame holder 102, and normal operation quickly follows.

Although embodiments are described as including a system control unit that is configured to control transition between a startup mode and an operational mode, alternative embodiments are operated manually. For example, according to an embodiment, the horizontally-fired burner 600 is configured such that an operator manually switches the electrode position controller to move the second electrode 604. According to another embodiment, the operator manually extends and retracts the second electrode 604. Additionally, according to an embodiment, an operator manually switches a voltage signal to the first and second electrodes 602, 604, and switches the signals off when the perforated flame holder 102 exceeds the startup threshold.

Figure 7:
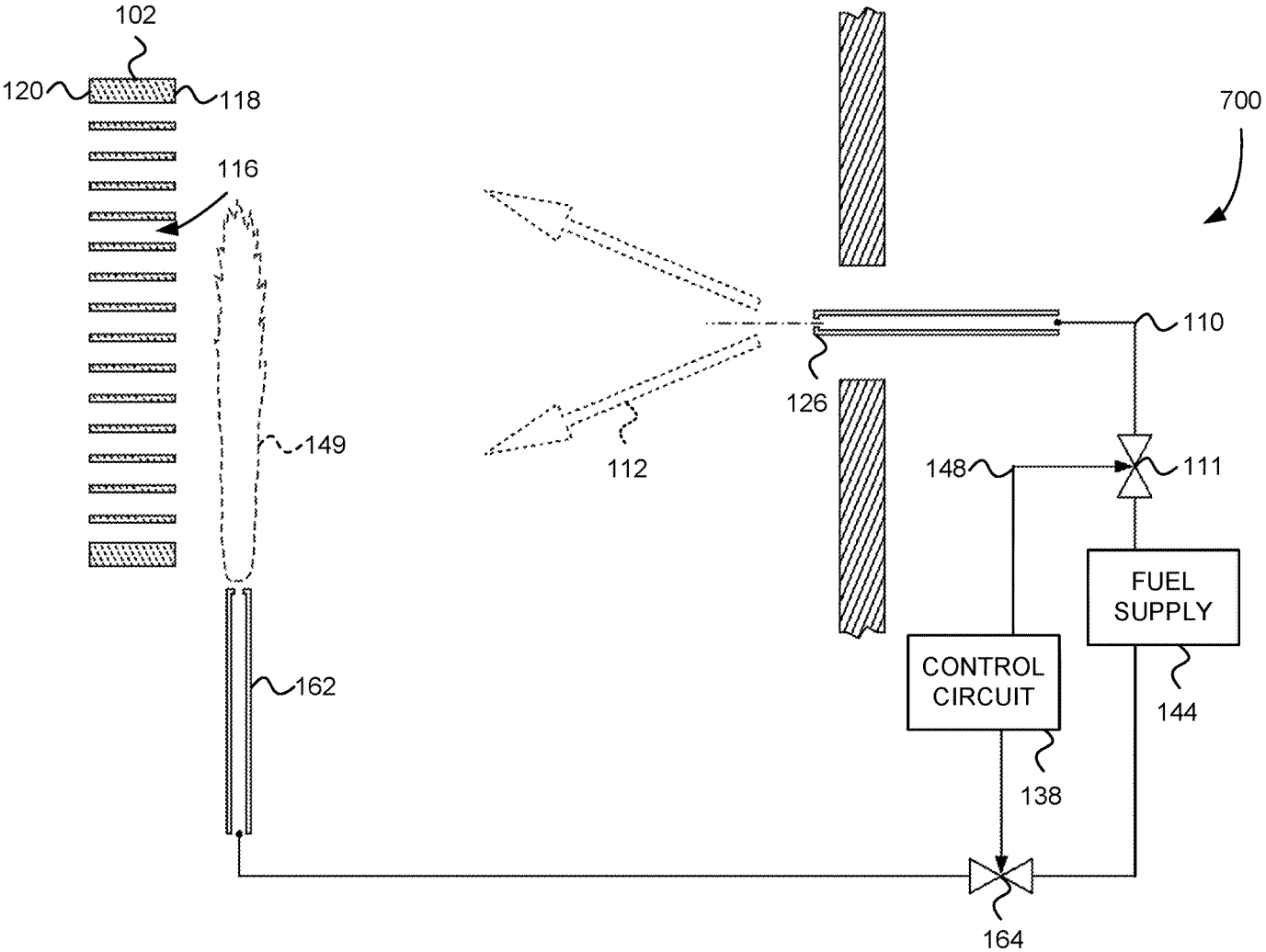
FIG. 7 is an illustration of a preheating mechanism of horizontally-fired burner system, according to one embodiment.

FIG. 7 is a diagrammatic side sectional view of a horizontally-fired burner 700, according to an embodiment. In the horizontally-fired burner 700, the nozzle 126 is a primary nozzle, and the system further includes a secondary nozzle 162 positioned between the primary nozzle and the perforated flame holder 102. The fuel supply 144 is coupled to the primary nozzle 126 and the secondary nozzle. A primary fuel valve 111 controls a flow of fuel from the fuel supply 144 to the primary nozzle 126, and a secondary fuel valve 164 controls a flow of fuel from the fuel supply 144 to the secondary nozzle 162. The system control circuit 138 is operatively coupled to the primary and secondary fuel valves 111, 164 via connectors 148.

In operation, when startup is initiated, the system control circuit 138 controls the secondary fuel valve 164 to open—the primary fuel valve 111 is closed—and ignites a stream of fuel that exits the secondary nozzle 162, producing a startup flame 149 that is directly adjacent to the input surface 118 of the perforated flame holder 102. The startup flame 149 heats a portion of the perforated flame holder 102 to a temperature exceeding the startup threshold. When the system control circuit 138 determines that a portion of the perforated flame holder 102 exceeds the startup temperature threshold—via, for example, a signal from a temperature sensor, as described previously—the system control circuit 138 controls the secondary fuel valve 164 to close, while controlling the primary fuel control valve 111 to open, causing a fuel stream 112 to be ejected by the primary nozzle 126. When the fuel and air mixture of the fuel stream 112 reaches the perforated flame holder 102, a primary flame is ignited and normal operation follows, substantially as described with reference to previously embodiments.

Figure 8:
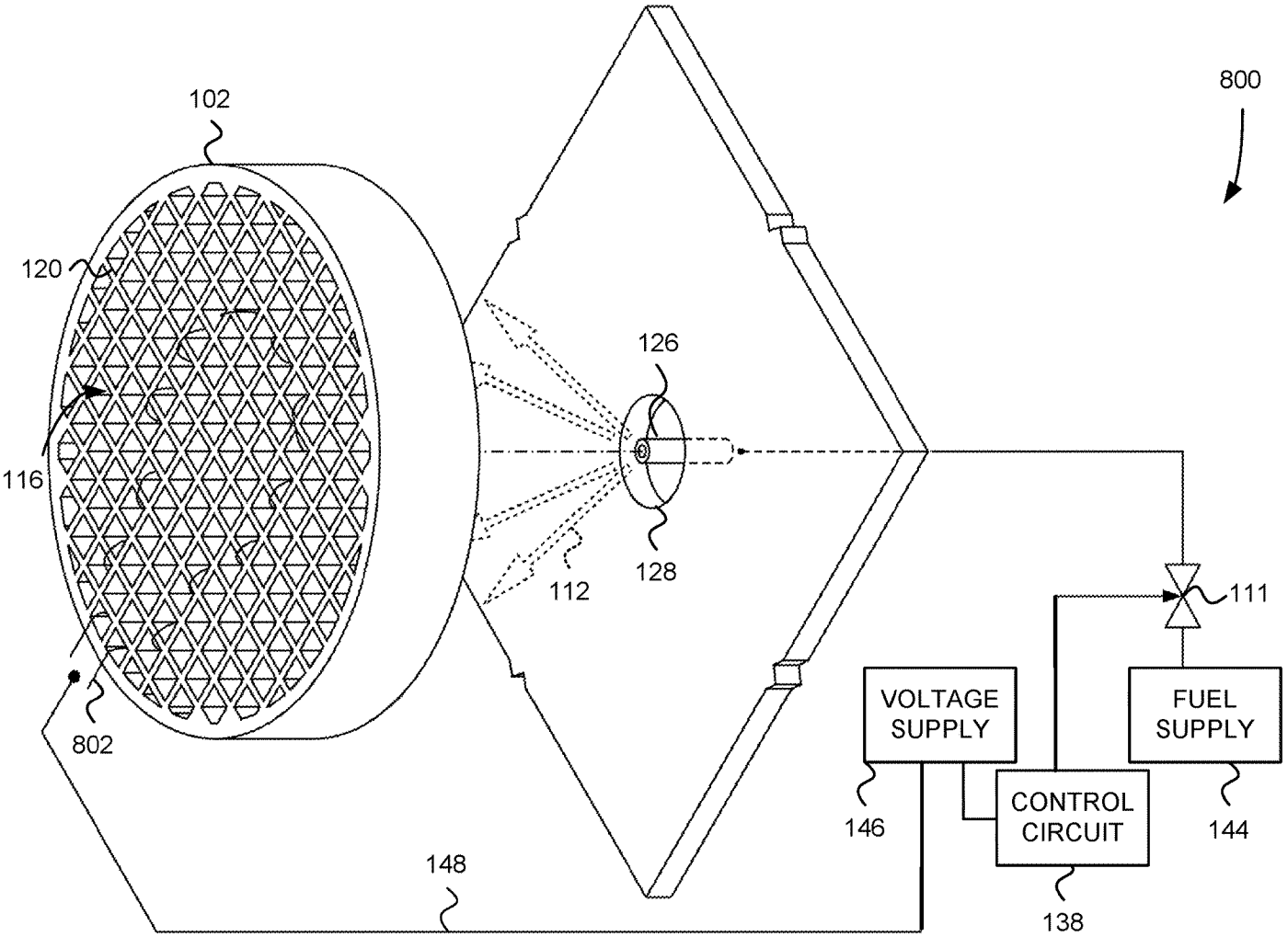
FIG. 8 is an illustration of a preheating mechanism of horizontally-fired burner system, according to one embodiment.

FIG. 8 is a diagrammatic perspective view of a combustion system 800, according to an embodiment. The burner system 800 is similar in many respects to the system 100 described with reference to FIG. 1, and includes many of the same elements. However, the system 800 also includes an electrically resistive heating element 802. In the embodiment shown, the heating element 802 is in the form of a wire that is interleaved in and out through some of the plurality of perforations 116. The heating element 802 is operatively coupled to a voltage supply 146 via a connector 148. During a startup procedure, the system control circuit 138 controls the voltage supply 146 to apply a voltage potential across the ends of the heating element 802. The resistance value of the heating element 802 and the magnitude of the voltage potential are selected to generate sufficient heat to raise the temperature of the portion of the perforated flame holder 102 in the vicinity of the heating element to beyond the startup threshold within a few seconds, after which the system control circuit 138 controls valve 111 to open, while controlling the voltage supply 146 to remove the voltage potential from the heating element 802. When the fuel stream 112 contacts the heated portion of the perforated flame holder 102, auto-ignition occurs, and a stable flame is established in the perforated flame holder 102. Thereafter, operation of the burner system 800 is substantially as described previously with reference to other embodiments.

Figure 9:
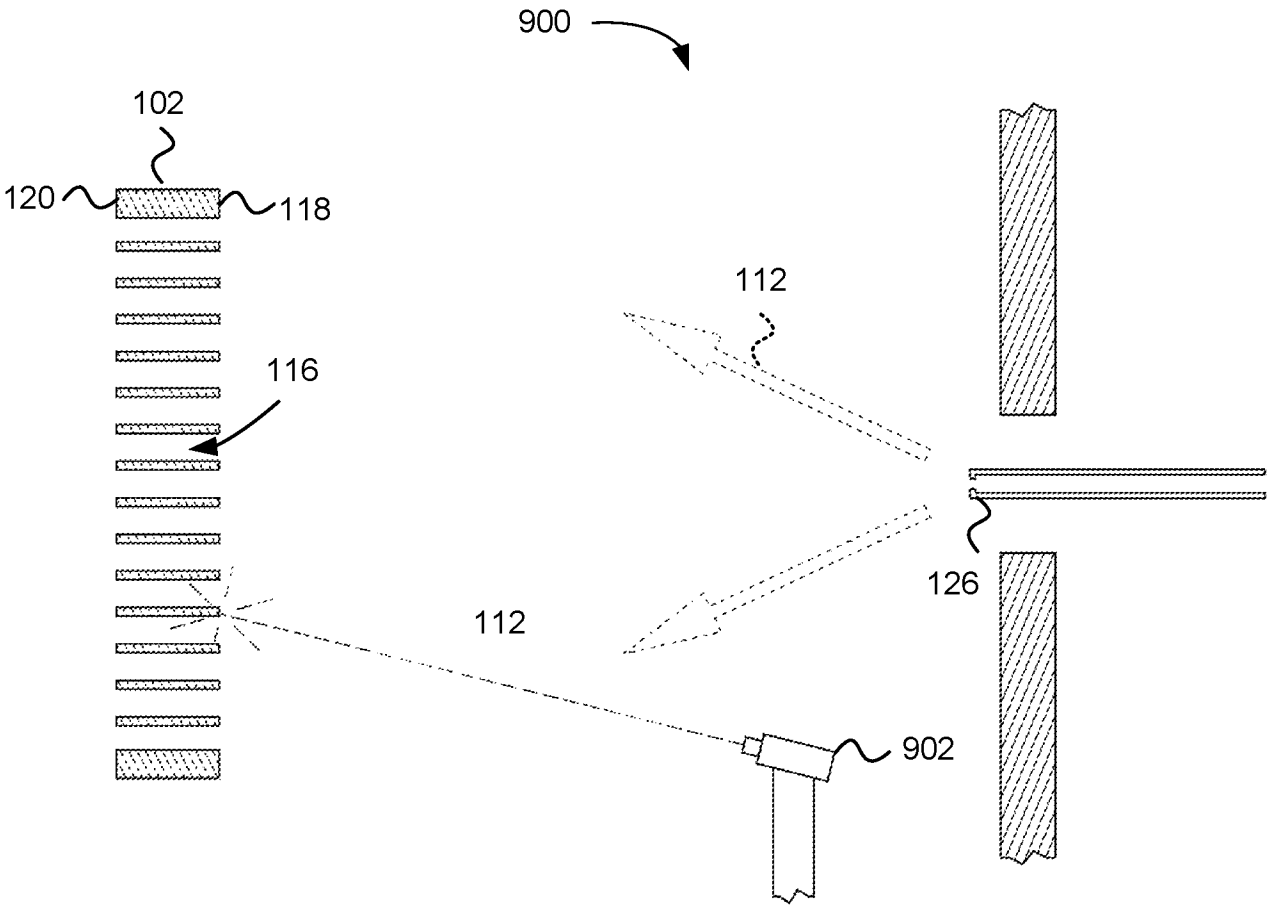
FIG. 9 is an illustration of a preheating mechanism of horizontally-fired burner system, according to one embodiment.

FIG. 9 is a diagrammatical side view of a combustion system 900, according to an embodiment. The combustion system 900 includes a laser emitter 902 positioned and configured to emit a laser beam that impinges in a portion of the input surface 118 of a perforated flame holder 102. Photonic energy delivered by the laser beam is converted into thermal energy within the perforated flame holder 102, thereby heating a portion of the perforated flame holder 102. When the portion of the perforated flame holder 102 exceeds the startup temperature threshold, fuel is sent to a nozzle 126 and ejected into a fuel stream 112 toward the perforated flame holder 102, and the laser 902 is shut down. In the embodiment shown, the laser 902 is held in a fixed position that is sufficiently removed from the perforated flame holder 102 and fuel stream 112 as to cause no interference with normal operation of the system, and to be substantially unaffected by the environment. According to another embodiment, the laser emitter 902 is positioned much closer to the input surface 118 of the perforated flame holder 102 for more efficient energy transfer. Accordingly, the laser 902 can also be retracted from the vicinity of the fuel stream when the system 900 is not in startup mode.

FIG. 9 shows a laser emitter configured to transmit energy in a non-thermal form, which is converted to thermal energy upon impinging on the perforated flame holder 102. According to various embodiments, other devices are configured to transmit non-thermal energy onto the perforated flame holder 102 to be converted to thermal energy. For example, according to an embodiment, a microwave transmitter is positioned and configured to direct a microwave emission onto a surface of the perforated flame holder 102. In that embodiment, the perforated flame holder 102 includes a patch of material that is configured to absorb the microwave emission and to convert a portion of the transmitted energy to heat.

Figure 10:
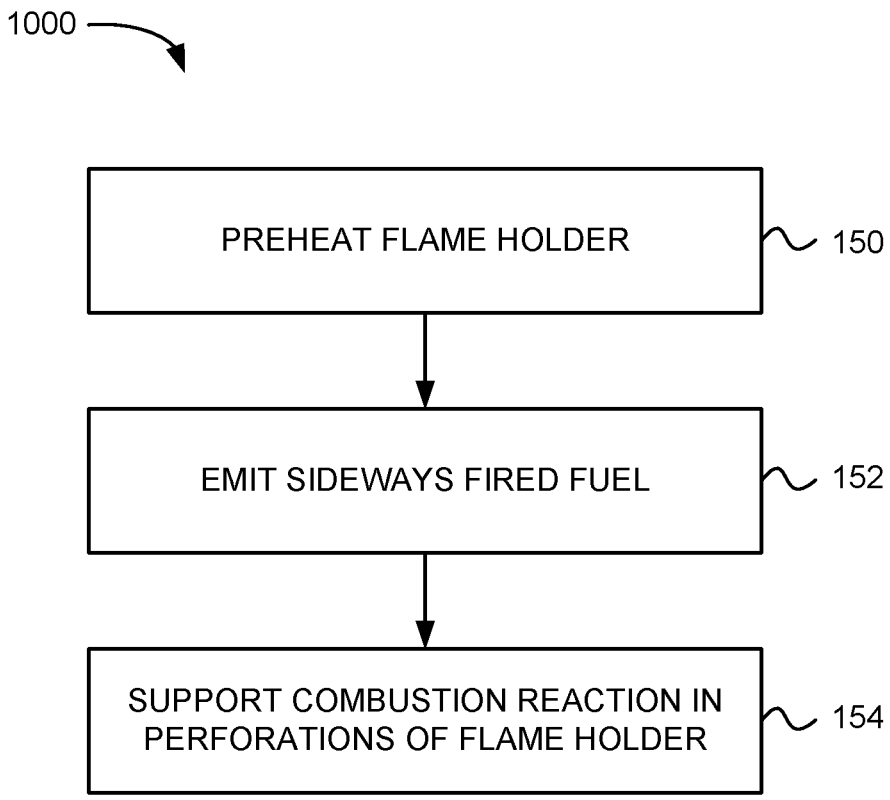
FIG. 10 is a flow diagram of a process for operating a horizontally-fired burner system including a perforated flame holder and a pre-heating mechanism, according to one embodiment.

FIG. 10 is a flow diagram of a process for operating a horizontally-fired burner including a perforated flame holder according to one embodiment. At 150 the perforated flame holder is preheated to a threshold temperature at which a combustion reaction of the fuel mixture can occur spontaneously. When the perforated flame holder reaches a threshold temperature, at 152 fuel is emitted from a horizontally-fired fuel nozzle. The perforated flame holder is positioned laterally from the horizontally-fired fuel nozzle such that the fuel expelled from the horizontally-fired fuel nozzle contacts the perforated flame holder. Because the perforated flame holder has been preheated to the threshold temperature, the fuel begins to combust upon contacting the preheated flame holder. As fuel from the horizontally-fired fuel nozzle continues to enter the perforations of the flame holder, the combustion reaction continues. At 154, the combustion reaction is supported primarily in the perforations of the perforated flame holder. This causes the perforated flame holder to continue to increase in temperature until a steady state operating temperature is reached.

In one embodiment, the process includes measuring the temperature of the flame holder and emitting the horizontally-fired fuel from the fuel nozzle only after the measured temperature of the flame holder has passed the threshold temperature.

In one embodiment the perforated flame holder is preheated by preheating mechanism positioned adjacent the perforated flame holder. Preheating mechanism can include a laser that irradiates the flame holder with a high-intensity laser beam until at least a portion of the flame holder has reached the threshold temperature. Alternatively, the preheating mechanism can be a second burner that generates a flame adjacent flame holder thereby heating the flame holder to the threshold temperature before outputting fuel from the nozzle.

According to one embodiment, the preheating mechanism can also be an electrical resistor coupled to the perforated flame holder. A current is passed through the resistor, thereby generating heat. Because the perforated flame holder is in contact with the resistor, the perforated flame holder heats up while the current is passed through the resistor.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A horizontally-fired burner comprising:

a horizontally-fired fuel nozzle configured to output, in a horizontal direction, a pure fuel jet selected to entrain oxidant;

a flame holder positioned laterally from the horizontally-fired fuel nozzle, the flame holder including:

an input surface facing the horizontally-fired fuel nozzle;

an output surface opposite the flame holder; and a plurality of perforations extending from the input surface to the output surface and collectively configured to promote a combustion reaction of the fuel within the perforations; and a preheating mechanism configured to heat the flame holder prior to starting the combustion reaction;

wherein the horizontally-fired fuel nozzle comprises an adjustable fuel nozzle; and wherein the preheating mechanism is configured to move the adjustable fuel nozzle closer to the flame holder during a preheating period and to retract the adjustable fuel nozzle away from the flame holder after the preheating period.

2. The horizontally-fired burner of claim 1, wherein the flame holder is configured to contain a majority of the combustion reaction within the perforations.

3. The horizontally-fired burner of claim 1, wherein the flame holder is configured to contain 80% or more of the combustion reaction within the perforations.

4. The horizontally-fired burner of claim 1, wherein the flame holder is a refractory material.

5. The horizontally-fired burner of claim 1, wherein the flame holder is an integral structure.

6. The horizontally-fired burner of claim 1, wherein the flame holder is configured to initiate the combustion reaction.

7. The horizontally-fired burner of claim 1, wherein the preheating mechanism comprises a second fuel nozzle configured to generate a flame adjacent the flame holder.

8. The horizontally-fired burner of claim 1, wherein the preheating mechanism comprises a laser configured to irradiate the flame holder.

9. The horizontally-fired burner of claim 1, comprising:

a temperature sensor configured to measure a temperature of the flame holder; and a control circuit coupled to the temperature sensor, the fuel nozzle, and the preheating mechanism and configured to cause the fuel nozzle to output the fuel when the temperature of the flame holder is above a threshold temperature.

10. The horizontally-fired burner of claim 9, wherein the threshold temperature corresponds to a combustion temperature at which the flame holder can initiate combustion of the fuel.

11. The horizontally-fired burner of claim 1, comprising a control circuit coupled to the preheating mechanism and the fuel nozzle and configured to initiate the fuel nozzle after the preheating mechanism has operated for longer than a threshold time.

12. The horizontally-fired burner of claim 1, wherein the perforations are isolated from each other by a body of the flame holder.

13. The horizontally-fired burner of claim 1, wherein the input and output surfaces of the flame holder are substantially rectangular.

14. The horizontally-fired burner of claim 1, wherein the input and output surfaces of the flame holder are circular, elliptical, or ovular.

15. The horizontally-fired burner of claim 1, wherein a width of the flame holder in a vertical direction is more than twice as large as thickness of the flame holder in a horizontal direction.

16. A method comprising:

using a preheating mechanism configured for heating a flame holder having a plurality of perforations each extending from an input surface of the flame holder to an output surface of the flame holder to heat the flame holder prior to starting a combustion reaction;

outputting pure fuel from a first nozzle in a horizontal direction, in a fuel jet selected to entrain oxidant, onto the input surface of the flame holder from an adjustable fuel nozzle;

igniting the combustion reaction of the fuel in the plurality of perforations;

containing the combustion reaction of the fuel substantially in the perforations in the flame holder; and moving the adjustable fuel nozzle closer to the flame holder during a preheating period and retracting the adjustable fuel nozzle away from the flame holder after the preheating period.

17. The method of claim 16, comprising:

measuring a temperature of the flame holder; and outputting the fuel onto the flame holder after the temperature of the flame holder has reached a threshold temperature.

18. The method of claim 17, wherein the threshold temperature is a temperature at which the combustion reaction will ignite in the flame holder.

19. The method of claim 16, wherein heating the flame holder comprises applying heat to the flame holder by flail the preheating mechanism being positioned adjacent the flame holder.

20. The method of claim 16, comprising heating the flame holder by irradiating the flame holder with a laser.

21. The method of claim 16, comprising heating the flame holder with a second fuel nozzle positioned adjacent the flame holder.

22. The method of claim 16, comprising heating the flame holder by passing a current through an electrical resistor coupled to the flame holder.

23. The method of claim 16, comprising outputting oxygen in a horizontal direction from a second nozzle onto the first surface of the flame holder.

24. The method of claim 16, comprising outputting the oxygen in an airstream.

25. The method of claim 16, wherein the combustion reaction is a reaction of the fuel with the oxygen.

26. The method of claim 16, wherein the flame holder is of a refractory material.

27. The method of claim 16, wherein the perforations are isolated from each other by a body of the flame holder.

28. A system comprising:

a horizontally facing fuel nozzle configured to output pure fuel in a horizontal direction, in a jet selected to entrain oxidant;

a flame holder positioned laterally from the horizontally facing fuel nozzle, the flame holder including:

an input surface;

an output surface; and a plurality of perforations between the input and output surfaces, the flame holder being configured to confine a majority of a combustion reaction of the fuel within the perforations; and a preheating mechanism configured to heat the flame holder prior to starting the combustion reaction;

wherein the horizontally-facing fuel nozzle comprises an adjustable fuel nozzle; and wherein the preheating mechanism is configured to move the adjustable fuel nozzle closer to the flame holder during a preheating period and to retract the adjustable fuel nozzle away from the flame holder after the preheating period.

29. The system of claim 28, wherein the perforations of the flame holder are isolated from each other.

30. The system of claim 29, wherein the flame holder is configured to convey heat between the plurality of perforations.

31. The system of claim 28, comprising a wherein the preheating mechanism is positioned adjacent to the flame holder and is configured to preheat the flame holder to a threshold temperature prior to outputting the fuel from the fuel nozzle.

32. The system of claim 31, wherein the threshold temperature is a temperature at which the flame holder can ignite the combustion reaction of the fuel.

* * * * *